US005300992A

United States Patent [19]

Wayman et al.

[11] Patent Number: 5,300,992

[45] Date of Patent: Apr. 5, 1994

[54] MOUNTING TAUT WIRES IN GENTLE, SELF-SPACED CONTACT WITH A ROLL

[75] Inventors: William H. Wayman, Ontario; Dan A. Hays, Fairport, both of N.Y.

[73] Assignee: Xerox Corporation, Stamford, Conn.

[21] Appl. No.: 986,237

[22] Filed: Dec. 7, 1992

[51] Int. Cl.[5] ..... G03G 15/06

[52] U.S. Cl. ..... 355/261; 355/263; 118/647; 118/649

[58] Field of Search ..... 355/246, 247, 249, 261-263, 355/259; 118/647-649, 651

[56] References Cited

U.S. PATENT DOCUMENTS 5,144,370 9/1992 Bares ..... 355/247
5,153,647 10/1992 Barker et al. ..... 355/261 X
5,153,648 10/1992 Lioy et al. ..... 355/247

*Primary Examiner*—Matthew S. Smith

[57] ABSTRACT

A non-interactive or scavengeless development system wherein taut wires are utilized for liberating toner particles from a donor member. Off-axis wire mounting allows taut wires to make gentler contact with a rotating roll without tight tolerance requirements. The wire is made to "float" on the roll to accommodate any roll runout.

2 Claims, 3 Drawing Sheets

MOUNTING TAUT WIRES IN GENTLE, SELF-SPACED CONTACT WITH A ROLL

BACKGROUND OF THE INVENTION

This invention relates generally to the rendering of latent electrostatic images visible. More particularly, the invention relates to non-interactive or scavengeless development systems wherein taut wires are utilized for liberating toner particles from a donor member.

The invention can be utilized in the art of xerography or in the printing arts. In the practice of conventional xerography, it is the general procedure to form electrostatic latent images on a xerographic surface by first uniformly charging a photoreceptor. The photoreceptor comprises a charge retentive surface. The charge is selectively dissipated in accordance with a pattern of activating radiation corresponding to original images. The selective dissipation of the charge leaves a latent charge pattern on the imaging surface corresponding to the areas not exposed by radiation.

This charge pattern is made visible by developing it with toner. The toner is generally a colored powder which adheres to the charge pattern by electrostatic attraction.

The developed image is then fixed to the imaging surface or is transferred to a receiving substrate such as plain paper to which it is fixed by suitable fusing techniques.

The present invention is especially useful in highlight color printing systems where the use of non-interactive development systems are desired. One form of highlight color imaging is described in U.S. Pat. No. 4,078,929 issued in the name of Gundlach. The patent to Gundlach teaches the use of tri-level xerography as a means to achieve single-pass highlight color imaging. As disclosed therein the charge pattern is developed with toner particles of first and second colors. The toner particles of one of the colors are positively charged and the toner particles of the other color are negatively charged. In one embodiment, the toner particles are supplied by a developer which comprises a mixture of triboelectrically positive and negative carrier beads. The carrier beads support, respectively, the relatively negative and relatively positive toner particles. Such a developer is generally supplied to the charge pattern by cascading it across the imaging surface supporting the charge pattern. In another embodiment, the toner particles are presented to the charge pattern by a pair of magnetic brushes. Each brush supplies a toner of one color and one charge. In yet another embodiment, the development systems are biased to about the background voltage. Such biasing results in a developed image of improved color sharpness.

In highlight color xerography as taught in the '929 patent, the xerographic contrast on the charge retentive surface or photoreceptor is divided into three levels, rather than two levels as is the case in conventional xerography. The photoreceptor is charged, typically to −900 volts. It is exposed imagewise, such that one image corresponding to charged image areas (which are subsequently developed by charged-area development, i.e. CAD) stays at the full photoreceptor potential ($V_{CAD}$ or Vddp). The other image is exposed to discharge the photoreceptor to its residual potential, i.e. $V_{DAD}$ or Vc (typically −100 volts) which corresponds to discharged area images that are subsequently developed by discharged-area development (DAD) and the background areas exposed such as to reduce the photoreceptor potential to halfway between the $V_{CAD}$ and $V_{DAD}$ potentials, (typically −500 volts) and is referred to as Vwhite or $V_W$. The CAD developer is typically biased about 100 volts closer to $V_{CAD}$ than Vwhite (about −600 volts), and the DAD developer system is biased about 100 volts closer to $V_{DAD}$ than Vwhite (about −400 volts).

The viability of printing system concepts such as tri-level, highlight color xerography requires development systems that do not scavenge or interact with a previously toned image.

In a non-interactive single component development system of the type contemplated, a controlled toner cloud is generated by the application of an AC voltage to taut wires in self-spaced contact with the toner layer on the donor roll. If the wires contact the donor roll with excessive force, toner could be physically removed from the donor roll and the donor roll coating could undergo mechanical wear and/or electrical breakdown. A gentle attractive force between the wire and the roll is required at all points along the roll and is provided in part by an electrostatic attraction due to the AC voltage. To accommodate roll runout, the wire mounting method must allow the wires to always follow the roll surface. With prior art mounting methods, the taut wires are attached to end blocks at mounting points approximately 125 μm below the surface of the donor. For mounting points ~10 mm beyond the ends of the donor roll, the reflection of the wire is about 1°. For a wire tension of 500 gm, the corner of the donor roll must support a load of 8 gm which is sufficient to remove toner near the roll ends. This load can also cause wear of the wire and donor coating and cause electrical failure if electrical arcing between the wire and donor occurs. Such a mounting method also makes it difficult to position spacer rollers near the ends of the donor to control the roll-to-receiver spacing.

The use of taut wires for liberating toner from the surface of a donor member and methods of mounting such wires are known in the prior art. For example, U.S. Pat. No. 5,031,570 granted to Hays et al on Jul. 16, 1991 and assigned to the same assignee as the instant application discloses a scavengeless development system for use in highlight color imaging. AC biased electrodes positioned in close proximity to a magnetic brush structure carrying a two-component developer cause a controlled cloud of toner to be generated which non-interactively develops an electrostatic image. The two-component developer includes mixture of carrier beads and toner particles. By making the two-component developer magnetically tractable, the developer is transported to the development zone as in conventional magnetic brush development where the development roll or shell of the magnetic brush structure rotates about stationary magnets positioned inside the shell.

U.S. Pat. No. 4,868,600 granted to Hays et al on Sep. 19, 1989 discloses a scavengeless development system in which toner detachment from a donor an dthe concomitant generation of a controlled powder cloud is obtained by AC electric fields supplied by self-spaced electrode structures positioned within a development nip. The electrode structure is placed in close proximity to the toned donor within the gap or nip between the toned donor and image receiver, self-spacing being effected via the toner on the donor. Such spacing enables the creation of relatively large electrostatic fields without risk of air breakdown.

U.S. Pat. No. 5,010,367 granted to Dan A. Hays on Apr. 23, 1991 discloses a scavengeless/non-interactive development system for use in highlight color imaging. To control the developability of lines and the degree of interaction between the toner and receiver, the combination of an AC voltage on a developer donor roll with an AC voltage between toner cloud forming wires and donor roll enables efficient detachment of toner from the donor to form a toner cloud and position one end of the cloud in close proximity to the image receiver for optimum development of lines and solid areas without scavenging a previously toned image. The wires are supported by the tops of end blocks. The wire extremities are attached so that they are slightly below a tangent to the surface to the donor roll.

U.S. Pat. No. 5,124,749 granted to Jan Bares on Jul. 23, 1992 discloses an apparatus in which a donor roll advances toner to an electrostatic latent image recorded on a photoconductive member. A plurality of electrode wires are positioned in the space between the donor roll and the photoconductive member. The electrode wires are electrically biased to detach the toner from the donor roll so as to form a toner cloud in the space between the electrode wires and photoconductive member. Detached toner from the toner cloud develops the latent image. A damping material is coated on a portion of the electrode wires. The damping material damps vibration of the electrode wires.

Although AC biased wires in contact with a toner layer on a donor roll have proven to be effective for achieving non-interactive xerographic development, the methods of mounting such wires needs improvement since they are difficult to mount in a consistent reproducible manner. Furthermore, the tensioned AC biased wires in self-spaced contact with the toned roll tend to vibrate which can cause nonuniform solid area development.

BRIEF SUMMARY OF THE INVENTION

The present invention provides an off-axis wire mounting method which allows taut wires to make gentle contact with a rotating roll without tight tolerance requirements. The wire is made to "float" on the roll to accommodate any roll runout. Two mounting methods will be described. One method tensions the wires by a member under tension. To this end the taut wires are strung or attached to a bow under compression and flexure.

The second method tensions the wires using another tensioned wire spaced 6 to 30 mm from the wires by T crossbars located just beyond the donor roll ends. Torsion wires are attached to the crossbars. When the wires are brought into contact with the donor roll, the force between the wires and donor is set by the twist in the torsion wires.

DETAILED DESCRIPTION OF THE PREFERRED EMBODIMENT OF THE INVENTION

Figure 6:
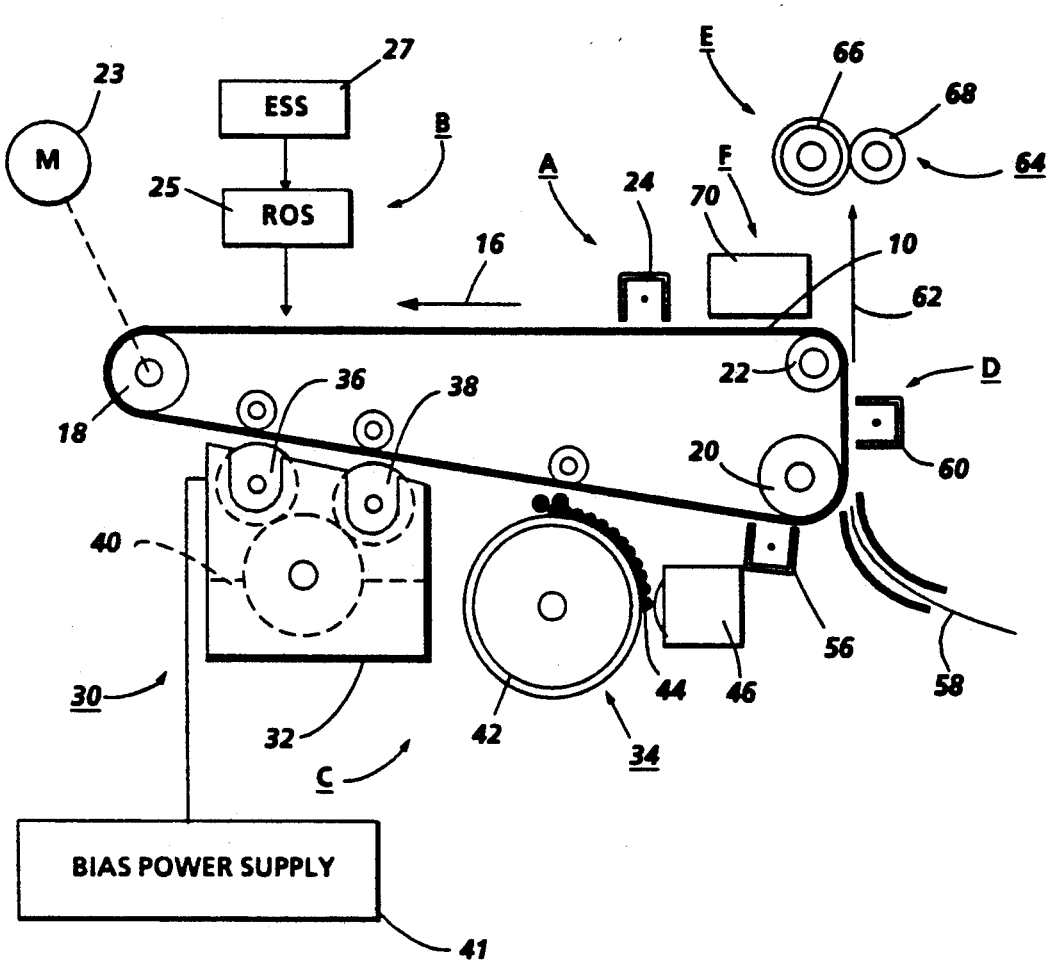
FIG. 6 is a schematic view of a printing apparatus in which the wire mounting devices can be utilized.

As shown in FIG. 6, a highlight color printing machine in which the invention may be utilized comprises a charge retentive member in the form of a photoconductive belt 10 consisting of a photoconductive surface and an electrically conductive substrate and mounted for movement past a charging station A, an exposure station B, developer station C, transfer station D and cleaning station F. Belt 10 moves in the direction of arrow 16 to advance successive portions thereof sequentially through the various processing stations disposed about the path of movement thereof. Belt 10 is entrained about a plurality of rollers 18, 20 and 22, the former of which can be used as a drive roller and the latter of which can be used to provide suitable tensioning of the photoreceptor belt 10. Motor 23 rotates roller 18 to advance belt 10 in the direction of arrow 16. Roller 18 is coupled to motor 23 by suitable means such as a belt drive.

As can be seen by further reference to FIG. 6, initially successive portions of belt 10 pass through charging station A. At charging station A, a corona discharge device such as a scorotron, corotron or dicorotron indicated generally by the reference numeral 24, charges the belt 10 to a selectively high uniform positive or negative potential, $V_0$. Any suitable control, well known in the art, may be employed for controlling the corona discharge device 24.

Next, the charged portions of the photoreceptor surface are advanced through exposure station B. At exposure station B, the uniformly charged photoreceptor or charge retentive surface 10 is exposed to a laser based input and/or output scanning device 25 which causes the charge retentive surface to be discharged in accordance with the output from the scanning device. Preferably the scanning device is a three level laser Raster Output Scanner (ROS). Alternatively, the ROS could be replaced by a conventional xerographic exposure device. An electronic subsystem (ESS) 27 provides for control of the ROS as well as other subassemblies of the machine.

The photoreceptor, which is initially charged to a voltage $V_0$, undergoes dark decay to a level $V_{ddp}$ equal to about $-900$ volts. When exposed at the exposure station B it is discharged to $V_c$ equal to about $-100$ volts which is near zero or ground potential in the highlight (i.e. color other than black) color parts of the image. The photoreceptor is also discharged to $V_w$ equal to approximately $-500$ volts imagewise in the background (white) image areas.

At development station C, a development system, indicated generally by the reference numeral 30 advances developer materials into contact with the electrostatic latent images. The development system 30 comprises first and second developer apparatuses 32 and 34. The developer apparatus 32 comprises a housing containing a pair of magnetic brush rollers 36 and 38. The rollers advance developer material 40 into contact with the latent images on the charge retentive surface which are at the voltage level $V_c$. The developer material 40 by way of example contains color toner and magnetic carrier beads. Appropriate electrical biasing of the developer housing is accomplished via power supply 41 electrically connected to developer apparatus 32. A DC bias of approximately −400 volts is applied to the rollers 36 and 37 via the power supply 41. With the foregoing bias voltage applied and the color toner suitably charged, discharged area development (DAD) with colored toner is effected.

The second developer apparatus 34 comprises a donor structure in the form of a roller 42. The donor structure 42 conveys developer 44, which in this case is a single component developer comprising black toner deposited thereon via a combination metering and charging device 46, to an area adjacent an electrode structure. The toner metering and charging can also be provided by a two component developer system such as a magnetic brush development structure. The donor structure can be rotated in either the 'with' or 'against' direction vis-a-vis the direction of motion of the charge retentive surface. The donor roller 42 is preferably coated with TEFLON-S (trademark of E. I. Dupont De Nemours) or anodized aluminum.

The developer apparatus 34 further comprises an electrode structure 48 which is disposed in the space between the charge retentive surface 10 and the donor structure 42. The electrode structure is comprised of one or more thin (i.e. 50 to 100 μm diameter) tungsten or stainless steel wires which are positioned closely adjacent the donor structure 42. The distance between the wires and the donor is approximately 25 μm or the thickness of the toner layer on the donor roll. Thus, the wires are self-spaced from the donor structure by the thickness of the toner on the donor structure. For a more detailed description of the foregoing, reference may be had to U.S. Pat. No. 5,010,367 granted to Dan A. Hays on Apr. 23, 1991

Figure 1:
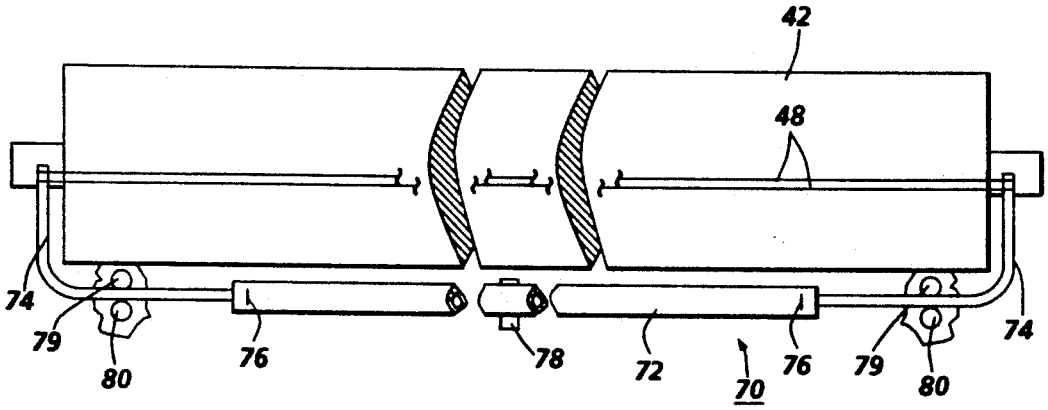
FIG. 1 is a schematic top plan view of a donor roll and toner liberating wires.
Figure 2:
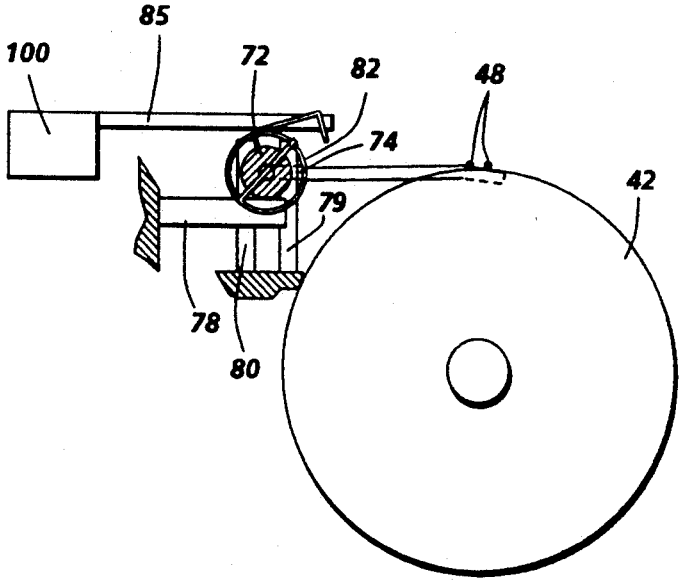
FIG. 2 is a schematic end elevational view of the structure depicted in FIG. 1.
Figure 3:
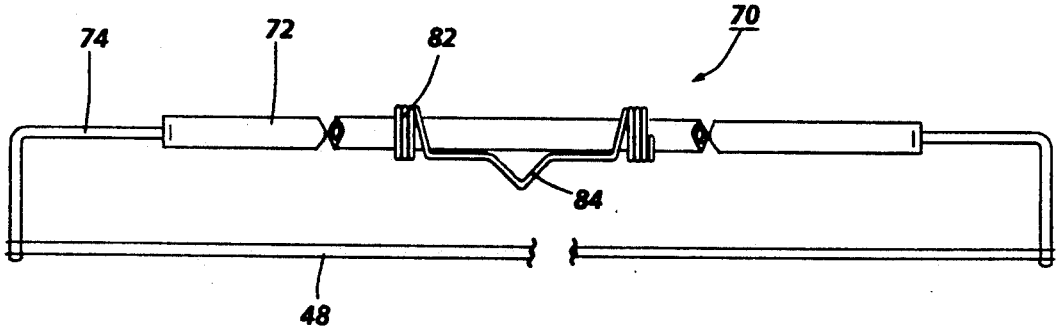
FIG. 3 is schematic top view of a wire mounting structure according to the present invention.

As illustrated in FIGS. 1 and 2, one embodiment of the invention for mounting the wires 48 relative to the donor roll 42 comprises a bow structure 70. The bow structure 70 is generally U-shaped and comprises a central tubular section 72 fabricated from 3.2 mm diameter stainless steel tubing. A pair of L-shaped bow ends 74 are fabricated from 1.6 mm hard tempered stainless steel spring wire such as piano wire. The bow ends are inserted into openings in the ends of the tubular section 72 and the tubular section is crimped as indicated at 76 for retaining the bow ends.

The bow was made longer than actually required by an amount such as to give the correct wire tension at the assembled wire length. In other words, the wires 48 are shorter than the distance between the legs of the L-shaped bow ends when not tensioned. The bow was strung in a fixture by wrapping suitable wire material about the L-shaped leg portions and applying glue for attaching the wires thereto. After the wires are attached, the ends of the wires are trimmed.

To provide proper contact force between the wires and roll, it is important to support the bow structure at a balance point near its center of mass. To this end a stationarily mounted pivot member 78 supports the bow in its operative position. A post member 85 cooperating with the pivot member 78 to position the bow therebetween serves an additional purpose to be discussed hereinafter. The post member 85 is stationarily supported by a frame member 100.

With the bow design, the distance which the wires extend beyond the ends of the donor roll is quite small, being in the order of 1–2 mm. This minimal spacing minimizes wire oscillations inherent with other mounting schemes. Also, by the use of such bow ends the journals or end mounts which support the donor roll structure can be positioned closer to the donor roll ends.

Figure 4:
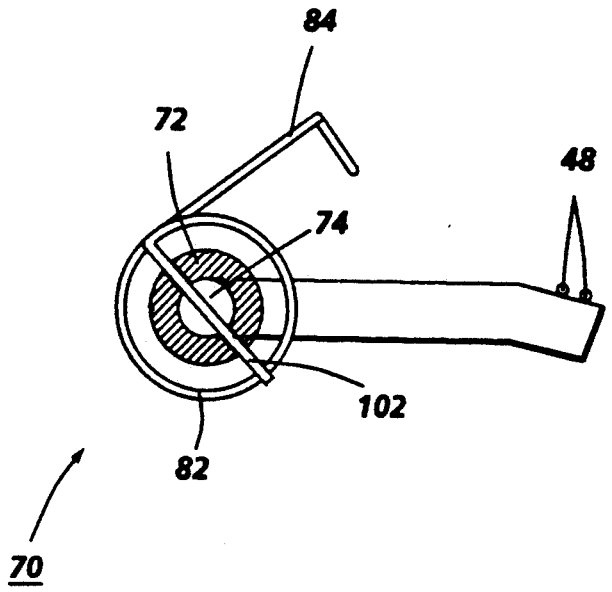
FIG. 4 is a partial view of a mechanical bias spring forming a part of the wire mounting structure of FIG. 3.

End constraint members 79 and 80 are provided which prevent the bow from twisting in a plane perpendicular to the plane formed by the bow. A bias spring 82 carried by the central tubular section 72 serves to urge the the bow and thus the wires 48 into engagement with the toner on the donor roll. To this end the spring is attached to the tubular section 72 by inserting spring ends 102 (FIG. 4) through openings in the tubular section 72. A notched segment 84 thereof engages the post member 85 (FIG. 2) disposed above the pivot member 78. When the tube portion 72 of the bow is installed between the constraint members 78, 79 and 80 which serve to captivate the bow 70, it is rotated counterclockwise as viewed in FIG. 2 in order to effect coiling of the spring 82. Thus, the spring 82 and the post member 85 cooperate to effect pressure loading of the wires 48 against the donor roll 42. Once it is installed in the foregoing manner, the bow and therefore the wires 48 are urged in a clockwise direction as viewed FIG. 2. This wire mounting method eliminates any high donor roll end force and associated wear/arcing problems. Since the bow structure extends only slightly beyond the donor roll, spacer rollers can be mounted near the donor for accurate donor-to-receiver spacing control.

Figure 5:
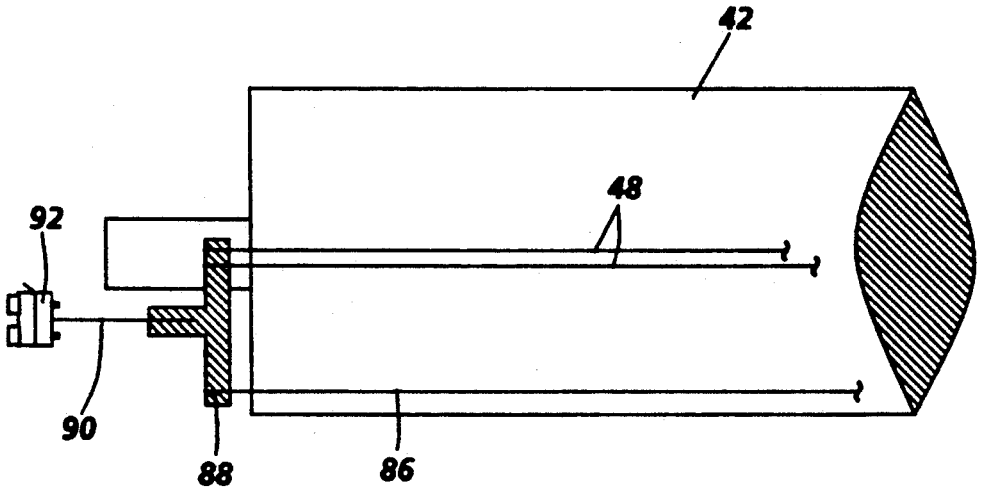
FIG. 5 is a fragmentary schematic view of a modified embodiment of a wire mounting structure.

In the embodiment of the invention illustrated in FIG. 5, the wires 48 are tensioned by another tensioned wire 86 which is spaced 6 to 30 mm from the wires 48 by T crossbars 88 located just beyond the donor roll ends. When the assembly is tensioned without constraints, the wires and crossbars form a plane with an orientation determined by the orientation of torsion wires 90 attached to wire mounts 92. When the wires 48 are brought into contact with the donor roll 42, the force between the wires and donor roll is set by the twist in the torsion wires. For 200 μm tungsten torsion wires 21 mm long and twisted by 6°, the force acting on each donor roll end is only 0.8 gm for a spacing between the wires and tensioned wire of 30 mm. The use of this wire mounting method also shows a reduction in toner clouding at the donor ends due to the reduced wire-to-donor end contact force. No arcing was observed when the toner was deliberately removed from the ends of the donor to expose the donor coating.

Referring now to FIG. 6, a sheet of support material 58 is moved into contact with the toner image at transfer station D. The sheet of support material is advanced to transfer station D by conventional sheet feeding apparatus, not shown. Preferably, the sheet feeding apparatus includes a feed roll contacting the uppermost sheet of a stack copy sheets. Feed rolls rotate so as to advance the uppermost sheet from stack into a chute which directs the advancing sheet of support material into contact with photoconductive surface of belt 10 in a timed sequence so that the toner powder image developed thereon contacts the advancing sheet of support material at transfer station D.

Because the composite image developed on the photoreceptor consists of both positive and negative toner, a positive pre-transfer corona discharge member 56 is provided to condition the toner for effective transfer to a substrate using negative corona discharge.

Transfer station D includes a corona generating device 60 which sprays ions of a suitable polarity onto the backside of sheet 58. This attracts the charged toner powder images from the belt 10 to sheet 58. After transfer, the sheet continues to move, in the direction of arrow 62, onto a conveyor (not shown) which advances the sheet to fusing station E.

Fusing station E includes a fuser assembly, indicated generally by the reference numeral 64, which permanently affixes the transferred powder image to sheet 58. Preferably, fuser assembly 64 comprises a heated fuser roller 66 and a backup roller 68. Sheet 58 passes between fuser roller 66 and backup roller 68 with the toner powder image contacting fuser roller 66. In this manner, the toner powder image is permanently affixed to sheet 58. After fusing, a chute, not shown, guides the advancing sheet 58 to a catch tray, also not shown, for subsequent removal from the printing machine by the operator.

After the sheet of support material is separated from photoconductive surface of belt 10, the residual toner particles carried by the non-image areas on the photoconductive surface are removed therefrom. These particles are removed at cleaning station F. The magnetic brush cleaner housing 9 is disposed at the cleaner station F. The cleaner apparatus comprises a conventional magnetic brush roll structure for causing carrier particles in the cleaner housing to form a brush-like orientation relative to the roll structure and the charge retentive surface. It also includes a pair of detoning rolls for removing the residual toner from the brush.

Subsequent to cleaning, a discharge lamp (not shown) floods the photoconductive surface with light to dissipate any residual electrostatic charge remaining prior to the charging thereof for the successive imaging cycle.

What is claimed is:

1. Apparatus for forming images on an image receiving surface with developer, said apparatus comprising:

developer material;

a donor member for transporting developer material to a development zone adjacent said image receiving surface;

a plurality of spaced apart electrodes positioned closely adjacent the surface of said donor member;

means operatively associated with said electrodes for forming transported developer into a cloud of marking particles in said development zone;

means for controlling the spacing of said cloud of marking particles relative to said image receiver without strongly interacting with said image receiving surface;

means comprising a pair of electrode mounts having said electrodes attached thereto for pivotally supporting said electrodes;

a tensioned wire attached to said electrode mounts;

torsion means for effecting a force between said donor roll and said electrodes when said electrodes are installed and means cooperating with said supporting means for urging said electrodes into an operative position relative to said donor member.

2. Apparatus according to claim 1 wherein said electrode mounts comprise T-shaped members having said electrodes and said tensioned wire attached between the tops thereof and wherein said torsion means comprises a pair of torsion wires attached to the legs of said T-shaped members and stationary means.

* * * * *